United States Patent [19]

Krieg et al.

[11] Patent Number: 5,070,827

[45] Date of Patent: Dec. 10, 1991

[54] LOW MASS VALVE LIFTERS

[75] Inventors: John J. Krieg, Spencerport; Christopher M. De Minco, West Rush, both of N.Y.; Steven F. Lowe, Drayton Plains, Mich.; Wayne S. Harris, Rochester; Michael J. Fox, Stafford, both of N.Y.

[73] Assignee: General Motors Corporation, Detroit, Mich.

[21] Appl. No.: 678,402

[22] Filed: Apr. 1, 1991

[51] Int. Cl.[5] ..... F01L 1/14; F01L 1/24

[52] U.S. Cl. ..... 123/90.48; 123/90.55; 123/90.51; 74/569

[58] Field of Search ..... 123/90.48, 90.49, 90.5, 123/90.51, 90.52, 90.55; 74/569

[56] References Cited

U.S. PATENT DOCUMENTS

| | | | |
|---|---|---|---|
| 2,019,138 | 10/1935 | Kliesrath et al. | 123/90.49 |
| 2,207,324 | 7/1940 | L'Orange | 123/90.48 |
| 2,863,432 | 12/1958 | O'Brien | 123/90.52 |
| 3,234,815 | 2/1966 | Line | 123/90.48 |
| 3,877,446 | 4/1975 | Morgan | 123/90.55 |
| 4,367,701 | 1/1983 | Buente | 123/90.55 |
| 4,448,155 | 5/1984 | Hillebrand et al. | 123/90.48 |
| 4,637,357 | 1/1987 | Ohmi | 123/90.48 |
| 4,699,094 | 10/1987 | Stegeman | 123/90.46 |
| 4,745,888 | 5/1988 | Kapp | 123/90.33 |

FOREIGN PATENT DOCUMENTS

| | | |
|---|---|---|
| 3806838 | 9/1989 | Fed. Rep. of Germany . |
| 3806839 | 9/1989 | Fed. Rep. of Germany . |

*Primary Examiner*—E. Rollins Cross
*Assistant Examiner*—Weilun Lo
*Attorney, Agent, or Firm*—Robert J. Outland

[57] ABSTRACT

Low mass hydraulic and mechanical valve lifters are shown and described. The lifters are of oblong configuration for reduced mass, with straight or narrowed sides connecting longitudinally spaced ends having depending semi-cylindrical end walls that are received in similarly shaped end portions of lifter gallery openings to absorb all longitudinal and lateral side loads. The lifters are preferably made by investment casting of steel alloys. The investment casting permits the use of thin semi-cylindrical walls at each end of the valve lifters which also have internal reinforcing ribs extending on their undersides.

12 Claims, 3 Drawing Sheets

LOW MASS VALVE LIFTERS

FIELD OF THE INVENTION

This invention relates to low mass valve lifters (also called tappets or cam followers) with or without hydraulic lash adjusters and particularly as used in engines for valve actuation. In preferred embodiments, it relates to so-called direct acting valve lifters.

BACKGROUND OF THE INVENTION

Increased efficiency in modern engines has resulted from valve train mass reduction, (for lower friction losses and/or higher engine speeds), and from increasing the number of valves per cylinder. Direct acting valve arrangements, as in overhead cam engines are of particular current interest since they can limit the reciprocating elements to the valves and their associated valve lifters.

Design efforts to reduce lifter mass have involved the use of Ceramics, metal matrix composites and magnesium, as well as other materials. But the cost of such materials, the special processing and the extensive development and testing required to use them can cause these designs to be cost prohibitive.

This invention provides means to minimize valve lifter mass through changes in geometry not requiring special materials. The valve lifter preferably has a cam lobe contact surface that is approximately the width of or slightly wider than the width of an associated cam lobe. The contact surface may be extended longitudinally (usually in the direction of the cam sliding motion) as desired to allow high velocity cam profiles to be used without requiring an increase in the width of the contact surface or the lifter. Semi-cylindrical end walls or skirts depend from the longitudinal ends of the cam lobe contact surface to guide and stabilize the lifter in the lifter gallery. The walls may be ribbed for strength.

A circular recess in a mechanical version of the lifter is adapted to receive a valve shim. In a hydraulic version of the lifter, a cylindrical depending wall between the semi-cylindrical skirts defines a cylinder to receive a hydraulic lash adjuster. In preferred embodiments, low mass and adequate strength characteristics are provided by the use of thin walls and reinforcing ribs preferably formed by investment casting.

The invention further provides a valve lifter having an oblong cam engaging portion with spaced longitudinal ends connected with depending semi-cylindrical end walls for carrying both longitudinal and lateral side loads applied to the lifter.

In combination in an engine, the invention provides a lifter carrier having an opening including spaced semi-cylindrical end portions and a valve lifter as above described guidingly received therein.

These and other features of the invention will be more fully understood from the following description of certain preferred embodiments taken together with the accompanying drawings.

DETAILED DESCRIPTION

Figure 1:
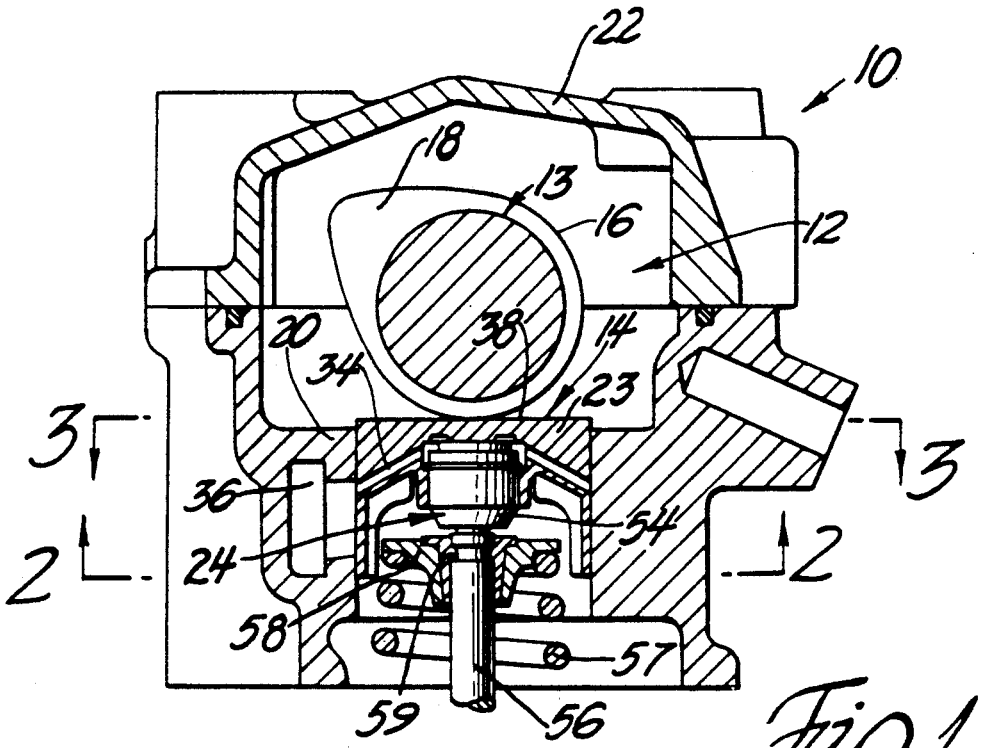
FIG. 1 is a cross sectional view of part of an engine cylinder head illustrating a hydraulic valve lifter and its associated cam.
Figure 2:
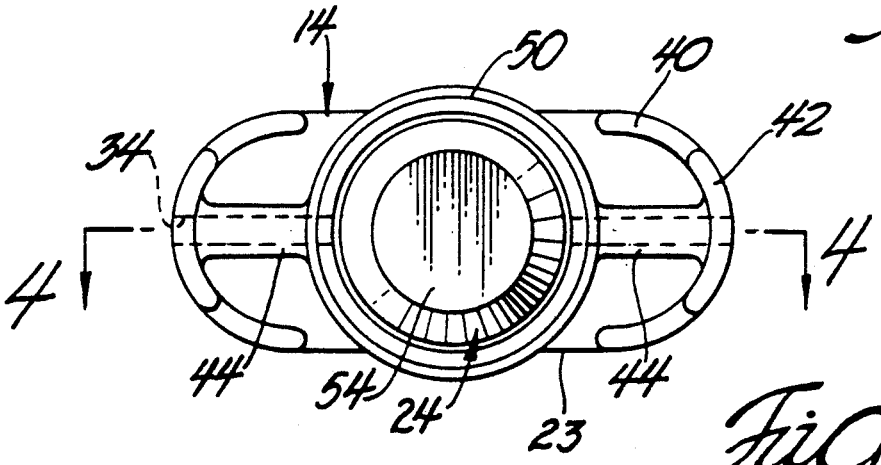
FIG. 2 is a view looking up at the hydraulic lifter and taken along the line 2—2 of FIG. 1.
Figure 3:
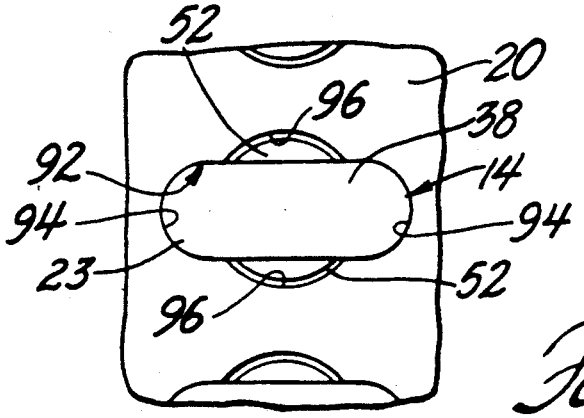
FIG. 3 is a partial view looking down at the lifter gallery showing the surface of several hydraulic lifters taken along the line 3—3 of FIG. 1.
Figure 4:
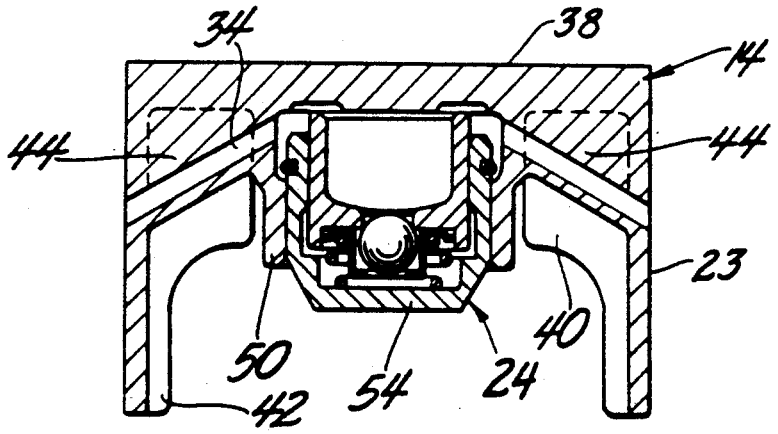
FIG. 4 is a cross sectional view of the hydraulic lifter taken along the line of 4—4 of FIG. 2.
Figure 5:
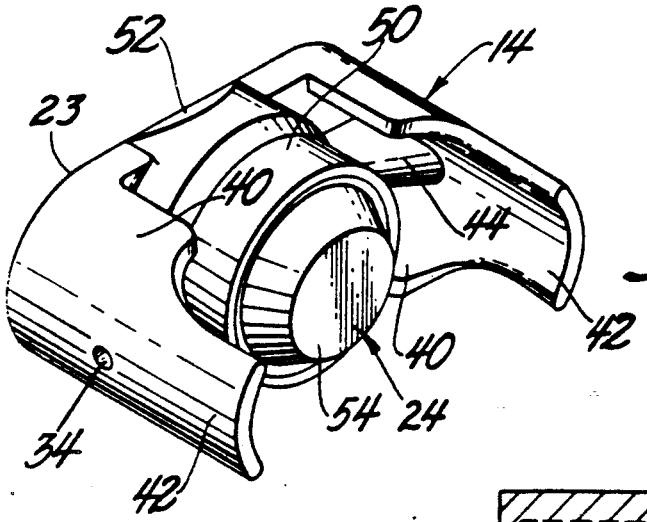
FIG. 5 is a perspective view of the hydraulic lifter.

The invention is directed towards valve lifters in valve mechanisms for engines. Referring now to FIGS. 1–5 an engine 10 with a lifter and cam gallery 12 has a camshaft 13 and a plurality of hydraulic valve lifters 14 operated by the camshaft through a plurality of cams 16 with lobes 18. The lifter gallery 20 and cam cover 22 may be made of aluminum, cast iron or other suitable materials while the camshaft 13 and hydraulic lifters 14 are preferably made of alloy steel, although other materials may be used within the scope of the invention.

Each hydraulic lifter 14 includes a follower body 23 carrying a conventional hydraulic element assembly or lash adjuster 24 which receives a supply of hydraulic fluid via passages 34 from a passage 36 in one wall of the lifter gallery. The cam-engaging top 38 of the follower body 23 is oblong with semicircular ends and generally parallel connecting sides. Semi-cylindrical end walls 40 depend from the semicircular ends. The walls 40 are optionally reduced in circumference at their bottom portions 42 to reduce the mass of the lifters. Vertically descending ribs 44 containing the hydraulic passages 34 connect the semi-cylindrical walls 40 with the underside of the cam engaging top 38.

Figure 9:
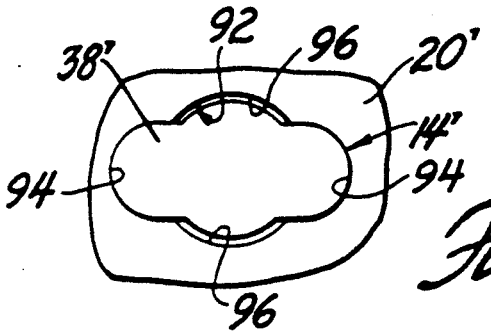
FIG. 9 is a view corresponding to FIG. 3 of an alternate form of a hydraulic lifter.

A cylindrical depending wall 50 descends from the center of the follower body 23 to define a closed-end cylinder that receives the hydraulic lash adjuster 24. This wall 50 as shown is slightly wider than the top 38 of the follower body with tapered upper edges 52. The conventional lash adjuster or hydraulic element assembly 24 includes a cup shaped piston 54 that engages the top of a valve stem 56. The valve stem 56 is urged upwardly by a compression spring 57 which engages a keeper washer 58 that is retained on the valve stem by split keepers 59 in the usual manner. If desired a smaller circular lash adjuster or even a narrower oblong unit could be used so that the wall 50 could be made as small as the width of the top 38. Also, as may be seen in FIG. 9, the tapered edges 52 may be eliminated, providing an outwardly bulging oblong flat top 38' of the lifter 14'.

Figure 7:
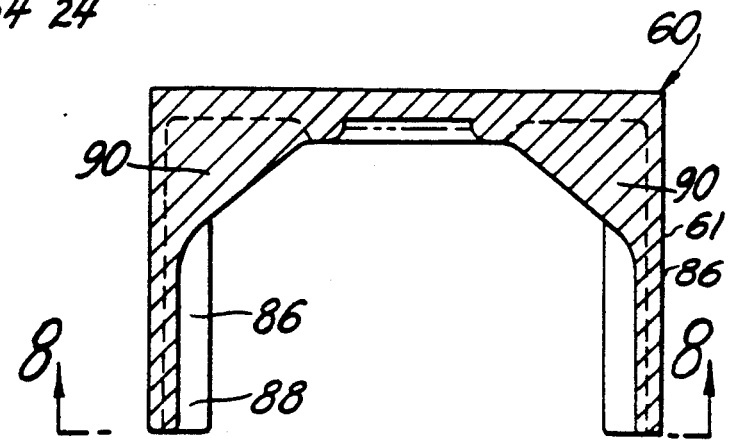
FIG. 7 is a longitudinal cross sectional view of the mechanical lifter taken along the line 7—7 of FIG. 8.
Figure 8:
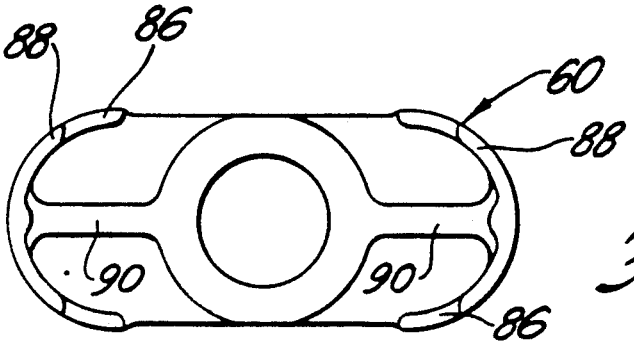
FIG. 8 is a view looking up at the mechanical lifter taken along the line 8—8 of FIG. 7.
Figure 6:
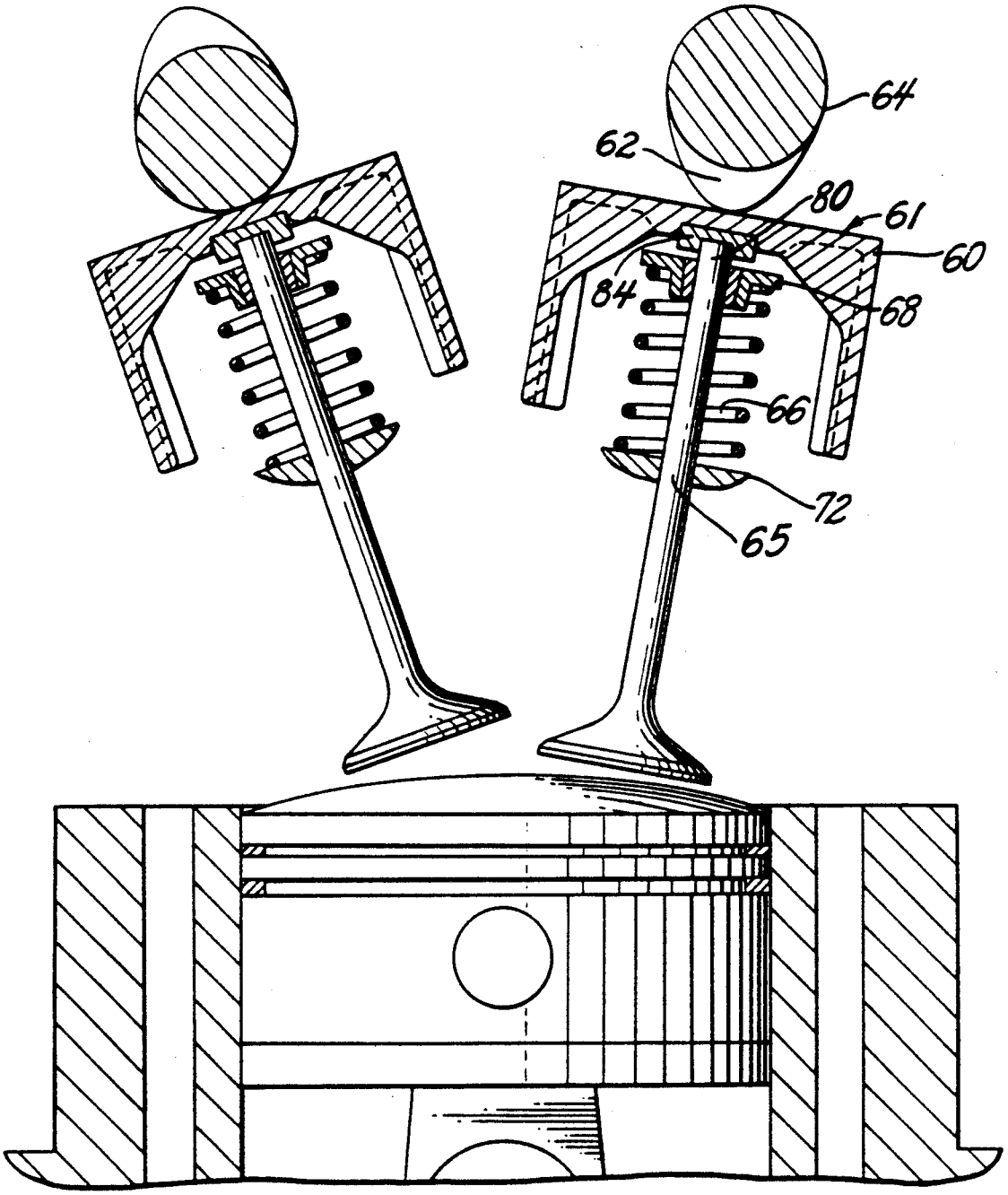
FIG. 6 is a partial cross sectional view of an engine illustrating a mechanical lifter.

Turning now to FIGS. 6, 7 and 8, a mechanical lifter 60 is shown which shares some of the features of the hydraulic lifter 14. Lifter 60 comprises a follower body 61 reciprocally actuated in a lifter guide (not shown) by a lobe 62 on a camshaft 64. The body 61 is engaged at its bottom by the end of a valve stem 65 which is urged upward by a compression spring 66 retained between a washer 68 holding keepers 70 and a cylinder head wall 72. The upper end 80 of the valve stem 65 carries a lash cap acting as a shim 84 that is received in a recess in the bottom of the follower body 61. Other types of shims could also be used. Semi-cylindrical depending walls 86 at the ends of the follower body 61 reduce in circumference at 88. Reinforcing ribs 90 provide increased rigidity of the body 61.

It should be understood that in some cases it might be desirable to extend the semi-cylindrical walls downwardly and eliminate the reduction in circumference. However, this could increase the mass of the lifter.

Oblong openings 92 in the lifter gallery 20 (FIG. 3) or 20' (FIG. 9), are provided to reciprocally receive the lifter. These openings may be made by casting, or by drilling three overlapping holes in line and thereafter finishing to size. The openings 92 preferably include small semicircular ends 94 which are engaged by the end walls 40 of the lifters 14 or 14' (or walls 86 of mechanical lifters 60) to carry both the lateral and longitudinal side forces imposed on the lifters in operation. The ends 94 are connected by arcs 96 of a large center circle. The arcs 96 are spaced with clearance outward from the sides of the vaive lifters 14, 14' so that all bearing loads are carried by the semi-cylindrical end walls 40. This provides good control of lifter motion and minimizes manufacturing tolerance problems since only the ends 94 of the openings are required to be closely dimensioned. Obviously, the enlarged portions shown as arcs 96 could be formed of any other suitable configuration or could be omitted from the lifter carrier structure if desired.

While the invention has been described by reference to certain preferred embodiments it should be understood that numerous changes can be made within the scope of the invention.

What is claimed:

1. A low mass valve lifter having a cam lobe contacting surface slightly wider than the width of an associated cam lobe and having an oblong configuration with longitudinally spaced half-circular ends connected by narrowed sides, said lifter having a semi-cylindrical wall depending from each end thereof.

2. A low mass valve lifter as set forth in claim 1 wherein each said end wall has a reduction in circumference along a portion of its length.

3. A low mass valve lifter as in claim 1 wherein said lifter is made with thin walls by the investment casting of an alloy steel.

4. A low mass valve lifter as in claim 2 wherein said lifter is made by casting of an alloy.

5. A low mass valve lifter having a width slightly wider than that of an associated cam lobe and having longitudinally spaced half-circular cylindrical end walls depending from longitudinal ends of the lifter and ribs depending from the underside of the lifter and connecting with said half-circular cylindrical walls, said ribs having passages for hydraulic fluids.

6. A low mass valve lifter as in claim 5 having a cylindrical wall depending from the underside thereof to contain a hydraulic lash adjuster.

7. A low mass valve lifter as in claim 6 wherein said lifter is made with thin walls by investment casting of a steel alloy.

8. A valve lifter made by investment casting of a steel alloy and having a thin oblong cam engaging wall and only thin longitudinally spaced end walls depending from longitudinal ends thereof, said lifter having thin ribs connecting the undersides thereof with the end walls.

9. A valve lifter having an oblong cam engaging portion with spaced longitudinal ends connected with depending half-circular cylindrical end walls for carrying both longitudinal and lateral side loads applied to the lifter.

10. In combination in an engine a lifter carrier having an opening including spaced half-circular cylindrical end portions, and a valve lifter reciprocally carried in said opening and having an oblong cam engaging portion with spaced longitudinal ends connected with depending half-circular cylindrical end walls, said end walls engaging said end portions of the opening to carry both longitudinal and lateral side loads applied to the lifter.

11. A valve lifter having an oblong cam engaging portion with longitudinal ends spaced in the direction of motion of an associated cam and connected with depending half-circular cylindrical end walls for carrying both longitudinal and lateral side loads applied to the lifter.

12. In combination in an engine a lifter carrier having an opening including longitudinally spaced half-circular cylindrical end portions, a valve lifter reciprocably carried in said opening and having an oblong cam engaging portion with longitudinally spaced ends connected with depending half-circular cylindrical end walls, said end walls engaging said end portions of the opening to carry both longitudinal and lateral side loads applied to the lifter, and a cam contacting said cam engaging portion for longitudinal sliding contact therewith between said ends.

* * * * *